US006544081B1

(12) United States Patent
Paulo

(10) Patent No.: US 6,544,081 B1
(45) Date of Patent: Apr. 8, 2003

(54) BOAT HULL WITH TUNNEL STRUCTURE

(76) Inventor: Douglas G. Paulo, 20674 Forest Ave., Castro Valley, CA (US) 94546

( * ) Notice: Subject to any disclaimer, the term of this patent is extended or adjusted under 35 U.S.C. 154(b) by 0 days.

(21) Appl. No.: 09/974,365

(22) Filed: Oct. 10, 2001

(51) Int. Cl.[7] ..... B63H 5/16
(52) U.S. Cl. ..... 440/69; 440/70
(58) Field of Search ..... 440/69, 70; D12/300, D12/310, 312

(56) References Cited

U.S. PATENT DOCUMENTS

| | | | |
|---|---|---|---|
| 3,515,087 | A | 6/1970 | Stuart |
| 3,745,936 | A | 7/1973 | Fisher |
| 3,811,399 | A | 5/1974 | Kobayashi et al. |
| 3,939,173 | A | 2/1976 | Stuart |
| 4,392,448 | A | 7/1983 | Shirley |
| 4,609,360 | A | 9/1986 | Whitehead |
| 4,622,016 | A | 11/1986 | Hankley |
| D301,573 | S | 6/1989 | Fuller |

*Primary Examiner*—Ed Swinehart
(74) *Attorney, Agent, or Firm*—George W. Wasson

(57) ABSTRACT

A boat hull having a tunnel structure along the bottom of the hull in the form of a truncated hollow partial cone indentation parallel to the keel of the boat. The tunnel has a truncated end attached to the bottom of the hull near the keel and an open end attached to the transom of the boat. The tunnel encloses a propeller shaft extending from the boat interior at the truncated end, the propeller shaft, a propeller and a rudder. The angle of the cone with respect to the keel places the propeller about 45% to 50% within the tunnel at planing attitude or speed. The combination of the tunnel placement along the hull and the axis of the propeller shaft increases the efficiency of the boat and reduces fuel consumption.

11 Claims, 3 Drawing Sheets

BOAT HULL WITH TUNNEL STRUCTURE

BACKGROUND OF THE INVENTION

1. Field of the Invention

This invention relates to a boat hull having a bow, a stern, and a keel along its bottom extending from the bow toward the stern and more particularly to a tunnel structure along the bottom of the boat hull in the form of a truncated hollow partial cone indentation parallel to the keel of the boat. The cone indentation begins near the apex of the cone and extends toward the stern of the boat where the base of the cone is secured to the stern or transom of the boat hull. The partial cone shaped tunnel accomodates the rotary propeller of the boat and the drive shaft to the propeller from the interior of the boat.

2. Description of the Prior Art

Prior art patents have disclosed the use of tunnel shapes along the keel of a boat for several different purposes. Mostly the prior art structures were intended to produce desireable wake patterns for water skiing, as in U.S. Pat. No. 4,392,448—Shirley, to overcome the tendency of turning the boat as the propeller rotates, as in U.S. Pat. No. 3,745,963—Fisher, and to converge water flow and increase water pressure aft of the propeller, as in U.S. Pat. No. 4,622,016—Hankley. The prior art has not directed the hull design to the desire to increase the efficiency of the drive from the boat's motor to the propeller through the hull and to increase efficiency of driving the boat when in planing attitude. In an inboard powered boat, it is desireable to have the axis of the propeller drive shaft as near as possible to parallel to the keel of the boat. It is also desireable to place the driven propeller in its most efficient alignment with the water surface during initial acceleration and after the boat has attained its planing attitude or speed. The prior art has not addressed the angle of the propeller drive shaft exit from the hull of the boat and the angle of the propeller drive shaft to the hull of the boat at the position of the propeller when in driving contact with the water.

SUMMARY OF THE INVENTION

The present invention is a modification of the hull of a boat by installing a concave partial cone shaped section along the hull with the propeller shaft running near the central axis of the partial cone shape. The partial cone shaped section produces a slot or tunnel indentation running longitudinally from the keel, where the propeller shaft exits through the bottom of the hull, to the transom at the stern of the boat. The slot or tunnel is aligned at an angle of approximately 6° to 12° upward from the keel and toward the transom. The angle and length of the slot is related to the diameter of the propeller which rotates in the slot and is related to the length of the propeller drive shaft. In the design of the present invention, the propeller shaft exits from the keel of the boat at about 1° to 5° down from the lay of the keel, depending upon the configuration of the bottom of the boat. The relationship of the angle of the slot to the keel and the exit angle of the propeller shaft is calculated to place about 45% to 50% of the propeller turning inside the cone slot tunnel when the boat is at its planing speed and attitude. The connection of the cone near its apex to the hull causes air to be introduced into the cone along with water to produce an air slot at the hull.

The purpose of the partial cone shaped tunnel slot of the present invention in the hull of a boat is three fold. The cone shaped air slot allows the suction of the water to be broken at planing through cruising speeds, making it a surface drive, but safer because all of the components are under the boat, unlike other existing surface drives. The cone shaped air slot allows the propeller shaft to be mounted almost parallel to the lay of the keel of the bottom of the boat. The cone shaped air slot and the alignment of the propeller shaft in the slot allows the boat to be operated in shallower waters, increases efficiency and reduces fuel consumption.

It is an object of the present invention to improve the efficiency of a boat by modifying the bottom of the boat to permit desired angles of cone-to-keel and propeller-to-keel in the boat hull.

A further object in accord with the preceding object is the formation of a partial cone shaped hollow tunnel slot along the hull of a boat with a continuous cone angle from the lay of the keel to the transom of the boat.

A further object in accord with the preceding object is to provide a truncation of the cone shaped tunnel slot at about its apex to provide an improved angle of exit of a propeller shaft from inside the boat to the inside of the slot.

A further object in accord with the preceding object is to align the axis of the cone slot and the angle of the keel of the boat to provide for the propeller shaft to exit the boat and into the tunnel at almost parallel to the keel.

Further objects and features of the invention will be readily apparent to those skilled in the art from the appended drawings and specification illustrating preferred embodiments wherein:

DETAILED DESCRIPTION OF THE PREFERRED EMBODIMENTS OF THE INVENTION

Figure 1:
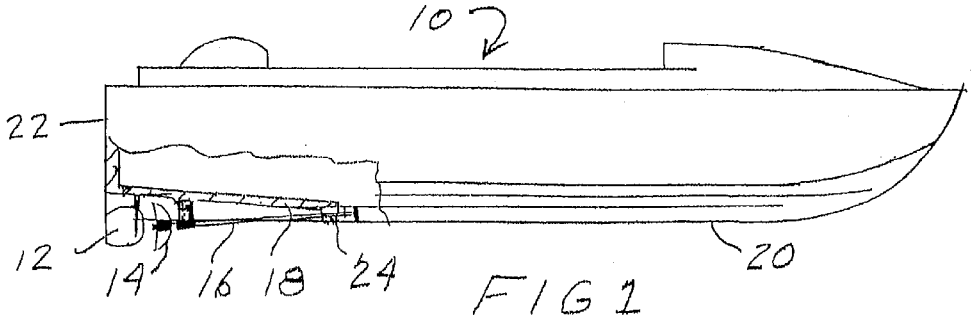
FIG. 1 is a side view, partially in section, of a V-shaped hull boat with a partial cone shaped tunnel slot of the present invention.
Figure 2:
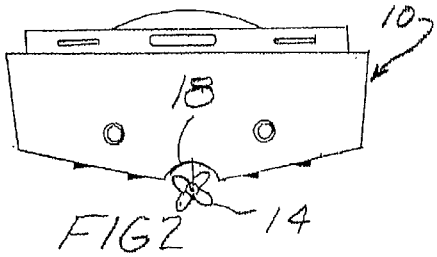
FIG. 2 is a rear elevation of the boat hull of FIG. 1 with a single propellar shaft.
Figure 3:
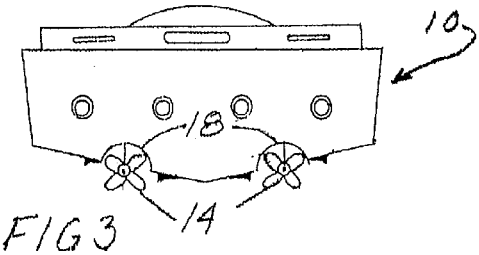
FIG. 3 is a rear elevation of a boat hull like FIG. 1 with twin propeller shafts.

FIGS. 1–3 illustrate an embodiment of the present invention in a V-shaped hull boat 10 with a portion of the stern of the boat removed to show the rudder 12, the propeller 14, propeller drive shaft 16 and the partial cone shaped tunnel slot 18 extending from the keel 20 toward the transom 22. The drive shaft 16 extends from the interior of the boat through the truncated end 24 of the tunnel slot 18. The internal boat engine is not shown and it should be well understood how the engine is connected through a transmission to the propeller drive shaft to exit from the boat hull through a suitable stuffing box and sealing bearing. FIGS. 2 and 3 illustrate the stern of the boat showing the propeller(s) 14 within the open end of the tunnel slot(s) 18.

Figure 4:
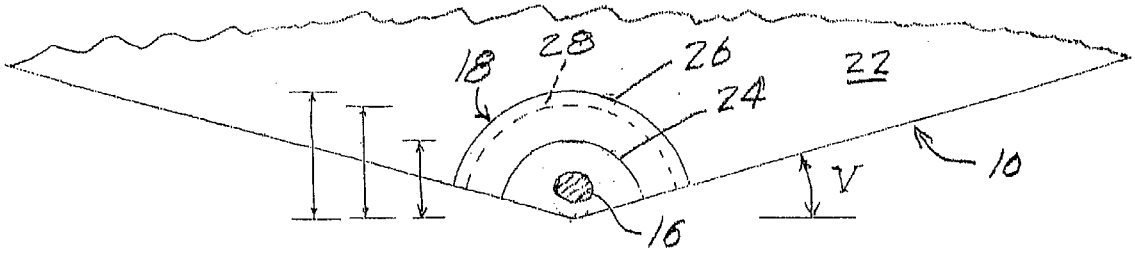
FIG. 4 is an enlarged partial rear elevation of a boat hull like FIG. 1 without propeller and rudder and showing the approximate diameter of the tunnel slot at the transom, at the propeller and at the entry of the propeller drive shaft from the hull to the slot.

FIG. 4 illustrates an enlarged view of the stern or transom 22 of the boat hull 10. At the transom, the open end of the tunnel cone 18 connects with the transom at 26 in a circular arc. The internals of the cone 18 include the truncated end 24 where the cone is connected to the hull at the keel 20. Also shown in dotted lines is the circumference of the path 28 of a propeller 14 (not shown). The position of the propeller drive shaft 16 within the cone shaped tunnel slot is shown in section.

Figure 5:
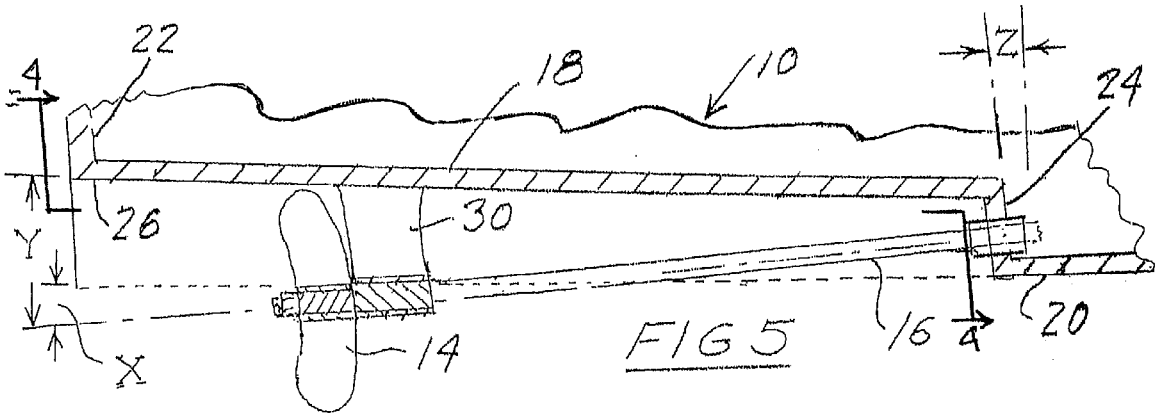
FIG. 5 illustrates an enlarged stern portion of the boat hull 10 with the tunnel slot 18 shown in section. The cone shaped tunnel slot is attached to the stern 22 at its open end 26 and at its truncated end closure 24 to the boat hull 10 at the keel 20 (not shown). The propeller 14 is shown at the end of the drive shaft 16 where the shaft is supported by a strut 30 fixed to the interior of the tunnel slot 18. The strut includes suitable bearings for rotary support of the shaft. The shaft 16 passes through the truncated end 24 of the tunnel slot 18 at its connection to the hull 10 at about the keel 20; a suitable bearing and stuffing box seals the shaft at the exit from the hull. The rudder, not shown, would be toward the transom and behind the propeller either within the tunnel slot or aft of the transom.

FIG. 5 illustrates an enlarged stern portion of the boat hull 10 with the tunnel slot 18 shown in section. The cone shaped tunnel slot is attached to the stern 22 at its open end 26 and at its truncated end 24 to the boat hull 10 at the keel 20 (not shown). The propeller 14 is shown at the end of the drive shaft 16 where the shaft is supported by a strut 30 fixed to the interior of the tunnel slot 18. The strut includes suitable bearings for rotary support of the shaft. The shaft 16 passes through the truncated end 24 of the tunnel slot 18 at its connection to the hull 10 at about the keel 20; a suitable bearing and stuffing box seals the shaft at the exit from the hull. The rudder, not shown, would be toward the transom and behind the propeller either within the tunnel slot or aft of the transom.

Shown in FIG. 5 in angular arrows is the angle X between the lay of the keel and the axis of the propeller drive shaft 16, the angle Y between the lay of the keel and the axis of the partial cone shaped tunnel slot 18, and the angle Z between the truncated end 24 of the slot 18 and almost perpendicular to the lay of the keel and normal to the axis of the drive shaft. The "lay of the keel" means the generally straight line of the keel toward the transom and represents the part of the boat that will be in contact with the water when the boat has obtained planing attitude or speed. "Normal to the axis of the drive shaft" means a truncation of the cone shape at an angle that will provide the desired entry of the drive shaft from the interior of the boat hull to the interior of the cone. The exit of the propeller shaft through a truncation as close as possible to perpendicular to the shaft will provide better sealing at the exit bearing. It is the intent of the alignments of the present invention to place the axis of the propeller shaft as flat as possible, that is horizontal, when the boat is in it planing attitude. It is also the intent of the present invention to position the propeller within the cone tunnel in a position where at least half of the propeller is engaging the water as the boat is propelled. To accomplish those intents, the cone tunnel starts far ahead of the propeller location and tapers upward from the keel to the transom. The forward end of the cone tunnel is truncated at its attachment to the boat at the keel to establish a step that breaks the suction between the hull and the water and provides a path for water and air to enter the cone to a position for engagement with the propeller. The cone angle is a constant angle from the keel attachment to the engagement with the transom and is a constant circular partial cone having a thickness consistant with the thickness of the hull, open at the bottom to establish a hollow partial cone with and the sides of the cone attached to the hull of the boat along the edges of the cone from the connection to keel at the truncated end to the connection to the transom.

As shown in FIG. 5, the angle X between the lay of the keel and the axis of the propeller shaft is preferrably as small as possible. The design of the engine and transmission in providing power to the drive shaft requires that there be some angle to get the shaft out of the hull. In accord with the present invention, the angle X should be between 1° and 5°. The angle Y between the axis of the cone tunnel and the lay of the keel is, to some extent, determined by the diameter of the propeller and the position of the propeller within the cone. In accord with the present invention, the angle Y should be between 6° and 12° upward from the keel to the transom. The angle between the axis of the propeller shaft and the interior surfaces of the cone should be between about 5° and 10°. The angle Z between the small truncated end of the cone at its attachment to the keel and almost perpendicular to the keel is determined to some extent by the axis of the propeller shaft. In accord with the present invention, the angle Z is the same as the propeller shaft angle with respect to the lay of the keel.

A boat is to be constructed using the design features of the present invention. That boat is a Vee hull boat about 21 feet in length with a beam of 95.5 inches. In that boat, the Vee angle is 15°, shown at V in FIG. 4. The length of the cone tunnel placed within the hull is 60" from the transom to the truncated end. The angle X betweem the lay of the keel and the axis of the propeller shaft is 3°, the angle Y of the cone tunnel interior surfaces with respect to the axis of the propeller shaft is 7°, the angle Z is 3°. In the boat being built, the cone is about 7⅝ inches in radius at the connection to the transom, the radius at the position of the propeller within the cone is about 7 inches, and the radius of the truncated end connected to the keel is about 4 inches. The propeller in the boat being built is about 14 to 18 inches from the transom with the strut forward of the propeller. These dimensions are representative of the angles and lengths and are varied depending upon the hull design, the length of the hull, the selected propeller and drive motor, and the intended use of the boat.

As shown in FIGS. 2 and 3, the truncated hollow partial cone tunnel structure is intended for use in single propeller Vee hulls as well as twin propeller driven hulls. In FIG. 3 there are two cone tunnels 18 at the stern of the hull, FIG. 2 shows a single propeller installation.

Figure 6:
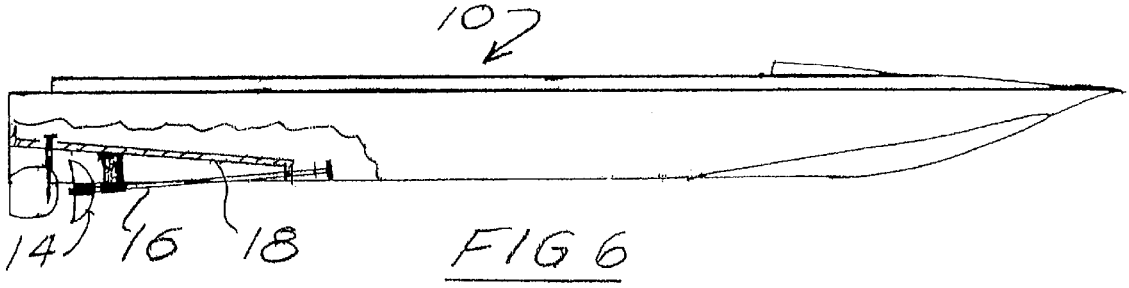
FIG. 6 is a side view of a flat bottomed boat hull, partially in section, showing the partial cone shaped tunnel slot of the present invention.
Figure 7:
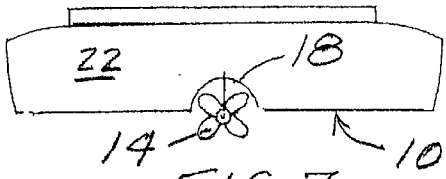
FIG. 7 is a rear elevation of the boat hull of FIG. 6 with a single propeller drive.
Figure 8:
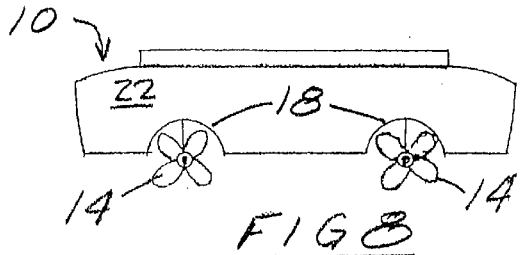
FIG. 8 is a rear elevation of a boat hull similar to FIG. 6 with twin propeller drive.
Figure 9:
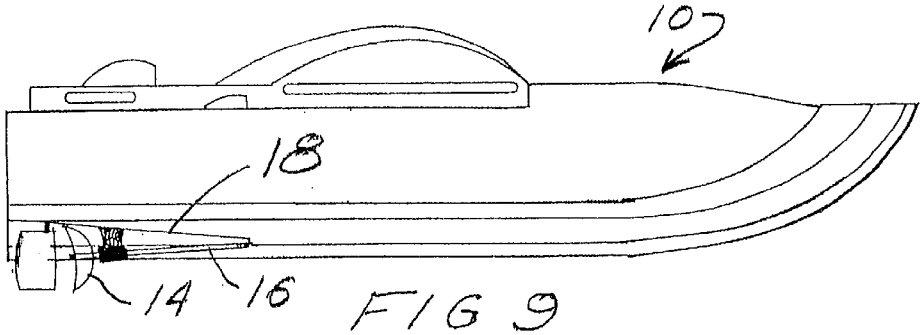
FIG. 9 is a side view of a catamaran boat hull showing a partial cone shaped tunnel slot of the present invention.
Figure 10:
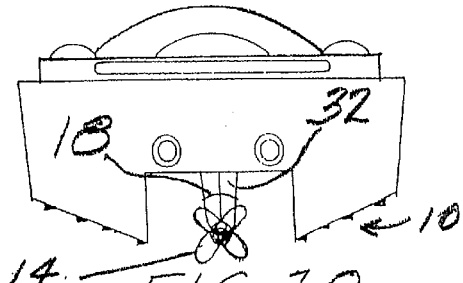
FIG. 10 is a rear elevation of a catamaran boat hull with the cone shaped tunnel slot of the present invention with a support structure in the central cavity of the boat hull.
Figure 11:
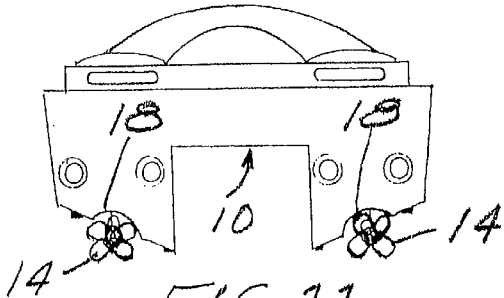
FIG. 11 is a rear elevation of a catamaran boat hull with the cone shaped tunnel slot in each of the side hulls of the catamaran.
Figure 12:
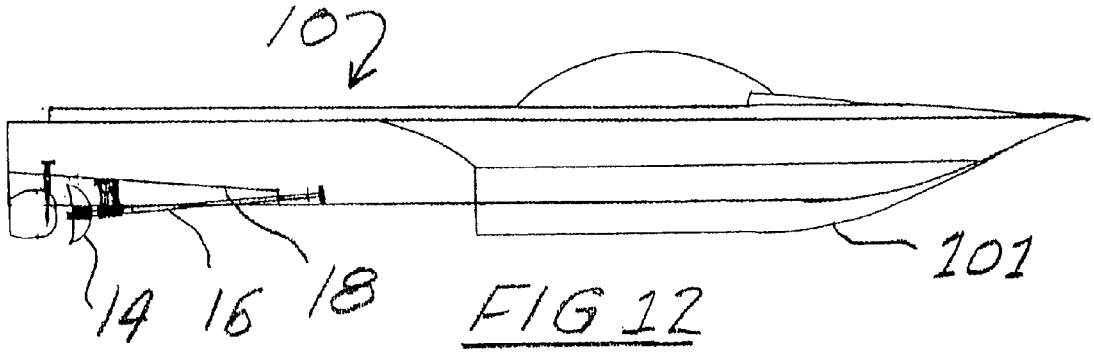
FIG. 12 is a side view of a hydroplane boat hull with a partial cone shaped tunnel slot of the present invention.
Figure 13:
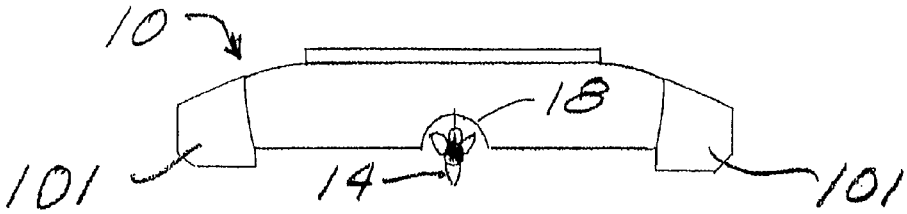
FIG. 13 is a rear elevation of the boat hull of FIG. 12.
Figure 14:
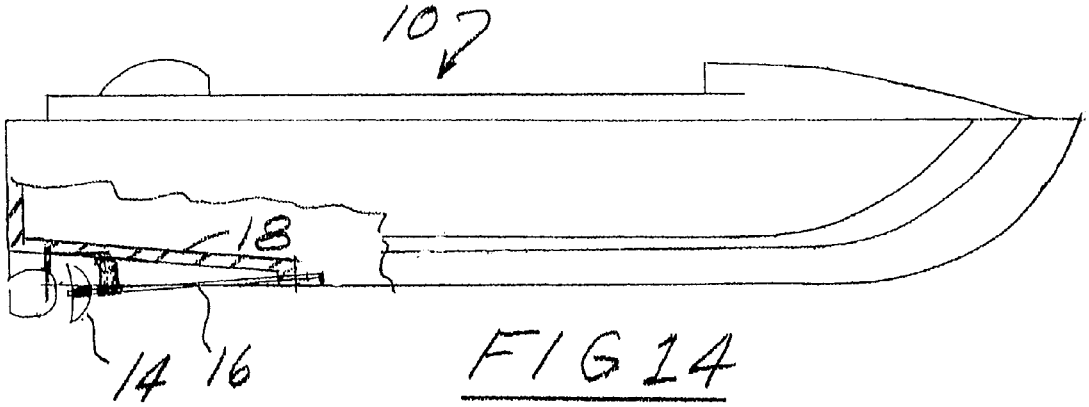
FIG. 14 is a side view of a tri-maran boat hull, partially in section, with a partial cone shaped tunnel slot of the present invention.
Figure 15:
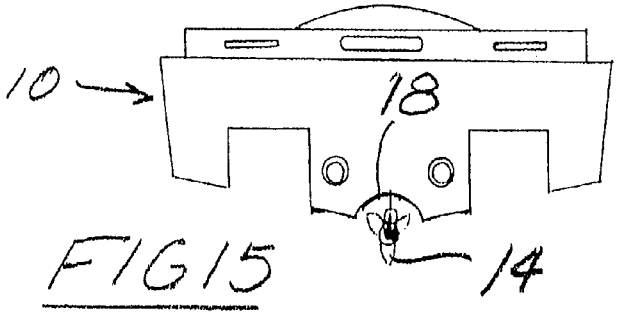
FIG. 15 is a rear elevation of the boat hull of FIG. 14.

The truncated hollow partial cone tunnel structure can be installed on many different boat hulls; FIGS. 6–15 illustrate four conventional boat hulls with the cone slot structure installed. In each of these FIGS, the same reference numerals from FIGS. 1–3 are used to designate the hull, cone and propeller. FIGS. 6–8 illustrate an installation on a flat bottom boat 10 with propeller shaft 16 within the tunnel slot 18; FIG. 7 as a single propeller boat and FIG. 8 as a twin propeller boat. FIGS. 9–11 illustrate an installation on a catamaran hull 10. FIG. 9 is a side view of the hull of FIG. 11. FIG. 10 is a single propeller installation and FIG. 11 is a twin propeller installation. It should be understood that in the single propeller installation of FIG. 10, a central support structure 32 is needed to support both the cone tunnel 18 and the drive shaft for the propeller 16. FIGS. 12 and 13 illustrate an installation on a hydroplane hull 10. In this type of hull the propeller should be rotating within a tunnel and have about half of the propeller in contact with the water when the boat is planing on the sponsons 101. FIGS. 14 and 15 illustrate an installation on a trimaran hull 10. In the installation shown in FIG. 15, the cone tunnel 18 and propeller 16 operate within the central hull of the trimaran.

The improved efficiency and reduced fuel consumption using the hull construction of the present invention is accomplished by getting the boat from standstill to planing attitude in a shorter period of time and by placing the drive propeller in its most efficient alignment with the water surface when the boat is planimg. It is expected that this improvement in efficiency can be as much as 20% to 25%.

While certain preferred embodiments of the invention have been specifically disclosed, it should be understood that the invention is not limited thereto as many variations will be readily apparent to those skilled in the art and the invention is to be given its broadest possible interpertation within the terms of the following claims.

I claim:

1. A hull structure for a boat, said hull having a bottom, a bow, a stern, and a keel extending at least partially from said bow to said stern along said bottom, a propeller shaft extending from the interior of said hull through said bottom and toward said stern from between said bow and said stern, said hull structure comprising:

a) a tunnel along said bottom of said hull, said tunnel presenting a truncated partial cylindrical cone shaped hollow surface indentation along said bottom of said hull, said cone having a central axis and a cone angle with respect to said central axis, the smaller forward end of said cone extending toward said bow and the enlarged trailing end of said cone extending toward said stern, b) said end of said cone at its forward end being truncated with an end closure and connected to said hull bottom to provide a substantially normal connection between said truncated end and the axis of said propeller shaft extending through said end closure and boat bottom and into said tunnel, c) the cone angle of said cone being constant from said connected truncated end toward said stern, d) said cone being attached to said bottom along its exterior surfaces extending to said stern and ending in attachment of said trailing end to said stern to establish said hollow tunnel, e) the central axis of said cone being aligned with said bottom and having said cone angle of about 6° to 12° with respect to said cone axis and said bottom.

2. The hull structure of claim 1 wherein said propeller shaft extending through said bottom of said hull extends through said truncated end closure of said cone and within said cone at an angle of about 1° to 5° downward with respect to said hull bottom.

3. The hull structure of claim 2 wherein said propeller shaft extending through said truncated end closure of said cone extends at an angle of about 5° to 10° with respect to the interior surface of said cone.

4. The hull structure of claim 1 wherein said propeller shaft passing through said substantially normal connection through said truncated end closure of said cone toward said hull bottom extends at about 1° to 4° downward with respect to said cone axis.

5. The hull structure of claim 1 with the addition of a propeller shaft support strut within said cone, said strut adapted to support said propeller shaft forward of said cone attachment to said stern.

6. The hull structure of claim 1 wherein said hull bottom is provided with a pair of said tunnels along said bottom, said tunnels being spaced equally on each side of said keel.

7. The hull structure of claim 1 wherein said hull is a hydroplane with side sponsons and a central flat bottom, said tunnel is an indentation along said central flat bottom.

8. The hull structure of claim 1 wherein said hull is a trimaran with side hulls and a central hull, said tunnel is an indentation along said central hull.

9. The hull structure of claim 1 wherein said hull is a catamaran with side hulls and a central hollow area, said central hollow area including a support structure for said tunnel indentation.

10. The hull structure of claim 1 wherein said hull is a catamaran with side hulls and a central hollow area, each of said side hulls having a tunnel indentation.

11. The hull structure of claim 1 wherein said truncated partial cylindrical cone shaped hollow surface indentation is about 4 inches in radius at said forward truncated end closure connection to said bottom, said indentation is about 7 to 8 inches in radius at said stern connection, said cone indentation length from said connection of said truncated end closure to said bottom at said attachment to said stern is about 60 inches, whereby a propeller of suitable size for said cone indention and driven by said propeller shaft and supported about 24 inches from said stern is in a position with about 45% to 50% of said propeller rotating within said indentation.

* * * * *